United States Patent [19]

Frye

[11] 3,979,567

[45] Sept. 7, 1976

[54] MICROPHONE COUPLER FOR HEARING AID HAVING INVERTED CONICAL END CONFIGURATION

[76] Inventor: George Joseph Frye, 12175 SW. Douglas, Portland, Oreg. 97225

[22] Filed: Feb. 18, 1975

[21] Appl. No.: 550,196

[52] U.S. Cl. ..... 179/175.1 A; 179/107 E; 179/1 C

[51] Int. Cl.[2] ..... H04R 29/00

[58] Field of Search ..... 179/175.1 A, 107 R, 179/107 E, 1 C, 2 C

[56] References Cited

UNITED STATES PATENTS

| | | | |
|---|---|---|---|
| 2,558,550 | 6/1951 | Fiske | 179/175.1 A |
| 3,619,507 | 11/1971 | Metz | 179/1 C |
| 3,692,959 | 9/1972 | Lamp | 179/175.1 A |
| 3,719,783 | 3/1973 | Kennedy | 179/1 C |
| 3,725,584 | 4/1973 | Kilmer et al. | 179/1 C |

*Primary Examiner*—Douglas W. Olms
*Attorney, Agent, or Firm*—Adrian J. LaRue

[57] ABSTRACT

A microphone coupler or artificial ear for coupling a microphone and a hearing aid to test the operational characteristics of a hearing aid includes a cavity having a predetermined volume, an opening extending from one end of the coupler to the cavity and is in communication therewith for receiving microphone means therein. The other end of the coupler has an inverted conical configuration in in which an ear mold of a hearing aid is to be disposed, and a hole extends between the inverted conical end and the artificial ear cavity. A non-hardening moldable material is positioned within the inverted conical end around the ear mold which mechanically holds the ear mold in position and provides acoustical sealing during testing of the hearing aid.

5 Claims, 3 Drawing Figures

MICROPHONE COUPLER FOR HEARING AID HAVING INVERTED CONICAL END CONFIGURATION

BACKGROUND OF THE INVENTION

Testing systems are commercially available to test the harmonic distortion and frequency response of hearing aids. Such a conventional test system is disclosed in U.S. Pat. No. 3,922,506, in the name of the present applicant, and it teaches the use of a microphone coupler between the sound pressure chamber and the signal processing and indicating means.

Conventional microphone couplers are provided with an artificial ear cavity of a prescribed volume which communicates with a bore in which a condenser microphone is sealingly positioned. Several types of microphone couplers are needed in order to test the various kinds of hearing aids.

These conventional forms of couplers have been recommended by the American National Standards Institute (ANSI) to test the various forms of hearing aids, but these couplers while capable of providing reproducible results, do not satisfactorily provide good measurement means for checking new hearing aid developments, such as, venting of ear molds and the use of all-in-the-ear hearing aids.

SUMMARY OF THE INVENTION

This invention relates to microphone couplers and more specifically to microphone couplers for testing all kinds of hearing aids.

An object of the present invention is to provide a microphone coupler which includes means for receiving the transmitting end of ear mold means therein.

Another object of the present invention is the provision of a microphone coupler which utilizes means to mechanically position the transmitting end of ear mold means and to provide acoustical sealing.

A further object of the present invention is to provide a microphone coupler means having one end in the form of an inverted cone in which the transmitting end of ear mold means is to be positioned.

An additional object of the present invention is the provision of a microphone coupler means which utilizes sealing means to acoustically seal transmitting end means of ear mold means in one end of the microphone coupler and mechanically maintain the transmitting end means in position in the one end.

A still further object of the present invention is to provide microphone coupler means to test the response of a complete hearing aid system.

These and other objects of the invention will appear more fully from the following description and the accompanying drawings illustrating a preferred embodiment of the invention. It is to be understood that changes may be made from the exact details shown and described without departing from the principles of the invention.

DETAILED DESCRIPTION OF THE INVENTION

Figure 1:
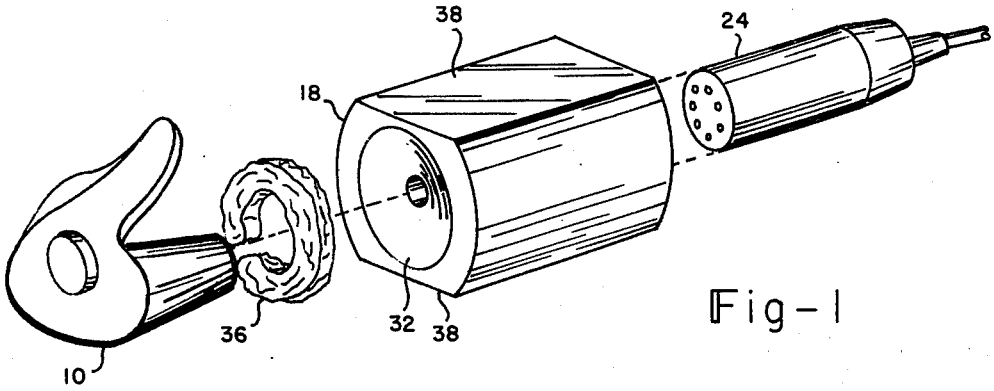
FIG. 1 is an exploded perspective view of elements of a microphone coupler system.

Turning now to the drawing, there is illustrated a conventional ear mold 10 which is molded from a suitable plastic material that normally fits in a specific person's ear. This ear mold has a delivery tube 12 and is sometimes equipped with a vent 14 which can alter the acoustic response of the hearing aid. The delivery tube 12 is acoustically driven by a conventional hearing aid (not shown). Ear mold 10 has a transmitting end 16 which transmits sound waves into an ear cavity when the ear mold is positioned within the external ear canal of the specific person for whom the ear mold is formed.

Microphone coupler 18 is made from a suitable rigid material, preferably aluminum, and it includes a cavity 20 which commonly has a volume of 2 cubic centimeters and this approximates the volume of an external ear between the transmitting end of an inserted ear mold and the tympanic membrane of the ear. Other more complicated cavity configurations are possible.

A bore 22 extends from one end of coupler 18 to cavity 20 and is in communication therewith. A conventional high acoustical impedance condenser microphone 24 is positioned within bore 22 and is retained therein by an o-ring 26 disposed in annular channel 28 which also provides sealing. Other suitable retaining means such as threads, can be utilized to hold the microphone in position. A shoulder 30 is located at the inner end of bore 22 against which the diaphragm end of microphone 24 abuts to establish the position of the microphone therein.

Figure 2:
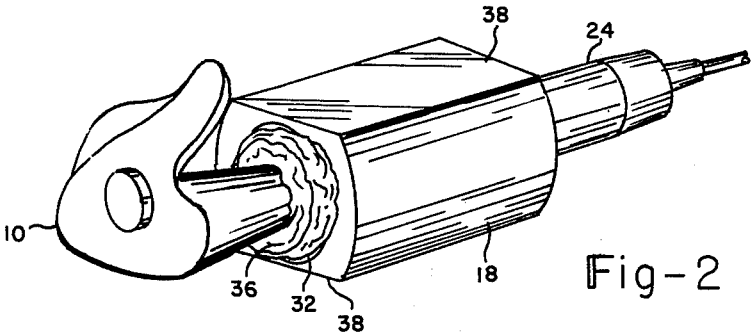
FIG. 2 is a perspective view of FIG. 1 in an assembled condition.
Figure 3:
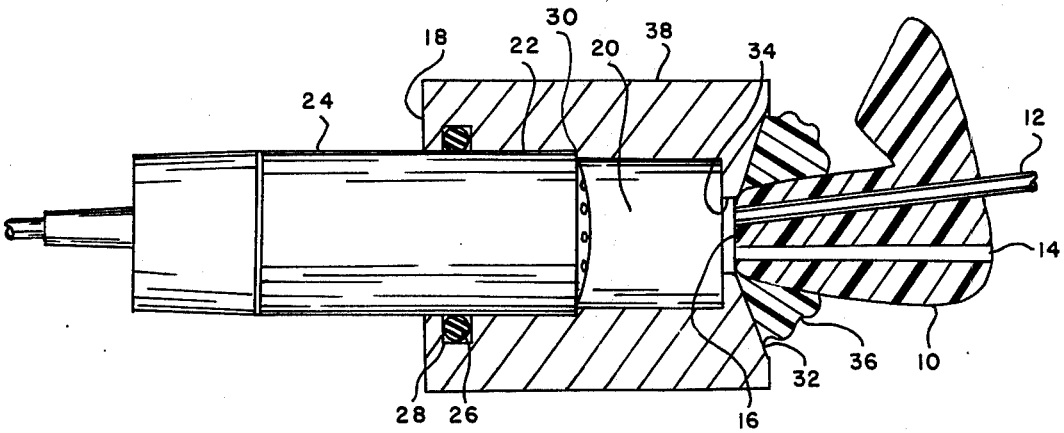
FIG. 3 is a cross-sectional view of the microphone coupler and ear mold.

The other end of coupler 18 has a surface 32 in the form of an inverted cone. A hole 34 provides communication between cavity 20 and the transmitting end 16 of ear mold 10 when the transmitting end is positioned against surface 32 as shown in FIGS. 2 and 3.

In order to maintain the transmitting end 16 of ear mold 10 in position against conical surface 32, a non-hardening moldable material 36 is formed onto surface 32 surrounding the transmitting end. Material 36 also provides an acoustic seal. Material 36 is preferably a commercially-available oil-based molding clay or silastic material; however, any suitable material can be utilized so long as it mechanically holds the ear mold in position and provides acoustical sealing. It may be desirable to have secured to surface 32 a flexible means to accommodate the transmitting ends of ear molds to sealingly maintain them in position.

Coupler 18 is provided with flat surfaces 38 which prevent the coupler from rolling out of a desired position.

Although the invention has been explained with reference to the particular embodiment, it is to be appreciated that various adaptations and modifications may be made without departing from the appended claims.

The invention is claimed in accordance with the following:

1. A microphone coupler for coupling a microphone and an ear mold of variable shape of hearing aid to test the operational characteristics of the hearing aid, said ear mold having a transmitting end, comprising:

a body member having a cavity means of predetermined volume therein and a bore extending from one end of said body member to said cavity means and being in communication therewith, said bore adapted to receive the microphone therein;

means for retaining the microphone in predetermined position in said bore;

surface means in the other end of said body member having an inverted conical configuration and having an aperture no greater than the outside diameter of the transmitting end of the ear mold for receiving thereagainst a transmitting end of the ear mold, said other end having a hole therein providing communication between the transmitting end of the ear mold and said cavity means; and means for acoustically sealingly maintaining the transmitting end of the ear mold against said surface means.

2. A microphone coupler according to claim 1 wherein said microphone retaining means comprises o-ring means disposed in channel means in said bore to sealingly maintain the microphone in position in said bore.

3. A microphone coupler according to claim 1 including shoulder means at the junction between said cavity and said bore to establish the position of the microphone in said bore.

4. A microphone coupler according to claim 1 wherein said maintaining means comprises non-hardening moldable material positioned on said surface means in engagement with the ear mold.

5. A microphone coupler according to claim 1 wherein said body member has flat external surfaces.

* * * * *